United States Patent [19]

Broadie

[11] 4,010,871

[45] Mar. 8, 1977

[54] DEVICE FOR DISPENSING THE CONTENTS OF A COLLAPSIBLE TUBE

[76] Inventor: Wilson L. Broadie, 842 Victor Ave., Inglewood, Calif. 90302

[22] Filed: Dec. 19, 1975

[21] Appl. No.: 642,619

[52] U.S. Cl. ..... 222/93; 222/100
[51] Int. Cl.[2] ..... B65D 35/24; B65D 35/34
[58] Field of Search ..... 222/97, 99, 100, 93

[56] References Cited

UNITED STATES PATENTS

| | | | |
|---|---|---|---|
| 1,799,678 | 4/1931 | Devlin | 222/97 |
| 2,570,077 | 10/1951 | Smith | 222/100 |
| 2,670,875 | 3/1954 | Perlmutter | 222/100 |
| 2,690,858 | 10/1954 | Peralta et al. | 222/93 |

FOREIGN PATENTS OR APPLICATIONS

| | | | |
|---|---|---|---|
| 108,353 | 8/1943 | Sweden | 222/100 |

*Primary Examiner*—Stanley H. Tollberg
*Assistant Examiner*—Hadd S. Lane
*Attorney, Agent, or Firm*—Kenneth J. Hovet

[57] ABSTRACT

A device is provided for dispensing materials contained within a collapsible tube. The device includes a spring-biased movable casing which is fitted within a housing and gradually moves upward into the housing as the contents of a collapsible tube mounted within the casing is expelled. The casing is provided with opposing longitudinal slots through which extends a shaft connected to the end of a collapsible tube. The dispensing outlet of the collapsible tube is extended through an orifice in the casing end cover. The upper portion of the casing is provided with a compression spring biased against the shaft and a top casing cover. The shaft is mounted between the stationary sidewalls of the housing for rotation, and as one twists the shaft and expells the contents of the collapsible tube, the compression spring will move the casing upwardly through the housing.

8 Claims, 6 Drawing Figures

DEVICE FOR DISPENSING THE CONTENTS OF A COLLAPSIBLE TUBE

BACKGROUND OF THE INVENTION

1. Field of the Invention

The present invention relates to a device for dispensing the contents of a collapsible tube and, more particularly, to a spring biased casing that encloses a collapsible tube and moves within a stationary housing as the contents of the tube are expelled.

2. Description of the Prior Art

Because of the well known propensity for collapsible tubes to rupture when folded over and squeezed, there has been a long felt need for a mechanical means that will evenly and effectively squeeze the tube and properly dispense the contents thereof. Of course, the rupturing and tearing of tubes becomes more prevalent when the materials contained therein are viscous. Additionally, because of the need for economizing, modern tubes are generally thin and are frequently punctured by multiple users and by the uneven application of pressure needed to discharge requisite quantities of materials. It is also desirable to provide a specified location for a dispenser of toothpaste or the like. This is especially true when there are multiple users of a toothpaste tube such as in a large family.

Various means have been devised in which a collapsible tube may be placed within a dispenser such as the telescoping plunger means described in U.S. Pat. No. 2,627,999. Of course, this technique results in the tube acquiring multiple misdirected wrinkles, and in fact, enhances the likelihood of ruptures and incomplete dispensation of materials.

Another technique for dispensing the contents of a tube is shown in U.S. Pat. No. 3,241,721. This patent describes a biased pressure roller to squeeze the tube. The disadvantage in this device is that it requires a separate movable carriage structure which operates in conjunction with a stationary housing.

U.S. Pat. No. 2,845,202 discloses a simplified toothpaste dispenser which uses a spring-biased arm pressing against the end of the tube as it is rotated. A problem with this device is that after the tube has been rolled into an increasing number of convolutions, the spring becomes less effective at completely expelling the tube contents. In fact, the tube itself may swing outwardly against the housing sidewalls and make it difficult to dispense accurate amounts of the tube contents.

SUMMARY OF THE INVENTION

In accordance with the present invention, there is provided a dispensing device that will reliably and effectively dispense the contents of a collapsible tube. The device includes a stationary housing having sidewalls and an integral support frame. The frame is adapted to support a casing slidably mounted therein. The casing is provided with opposing longitudinal slots through which extend a shaft. The shaft includes a collapsible tube engagement means and is mounted for rotation on the housing sidewalls.

The casing has an upper portion which is provided with a compression spring means that extends between the shaft and a top casing spring abutment means. A lower portion of the casing contains a collapsible tube with the bottom end thereof engaged with the tube end engagement means. The dispensing end of the tube abuts against a bottom abutment member which includes an orifice for the tube dispensing outlet.

To facilitate the even, complete evacuation of the tube contents, a disc is preferably interposed between the tube end and compression spring means lower end. The disc operates as an abutment between the end of the compression spring and distributes the axial force from the compression spring means substantially across the tube diameter.

The housing of the assembly may be provided with means for mounting one or more toothbrushes and includes a means for mounting the device upon a support structure such as a wall, cabinet, or the like. It is also within the contemplation of the present invention to include a valve means at the dispensing end of the tube to allow for a positive on-off flow of material from the collapsible tube.

DESCRIPTION OF A PREFERRED EMBODIMENT

Figure 1:
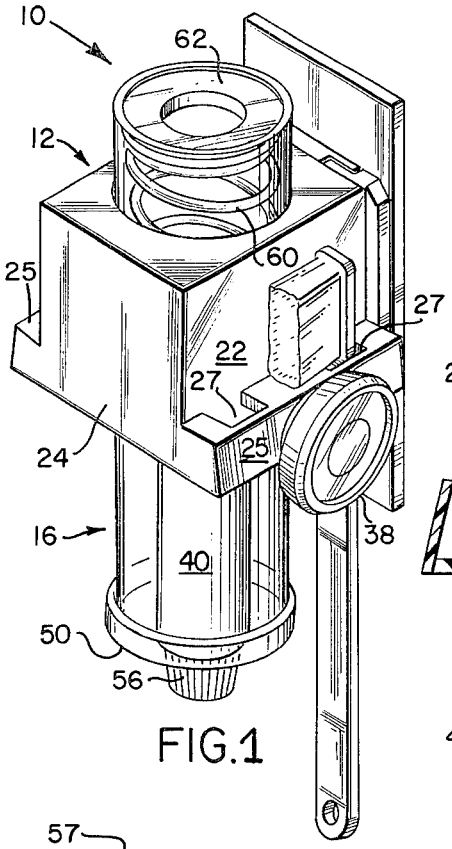
FIG. 1 is a perspective view of the dispensing device of the present invention when used as a toothpaste dispenser.

Referring now with greater particularity to the various Figures of the drawings, it will be seen that numeral 10 refers generally to the improved dispensing device of the present invention. The device includes a housing 12 having opposing sidewalls 22, a front wall 24, and a rear wall 26. The housing includes an integral support frame 14 for slidably supporting a movable casing 16. The support frame simply comprises an inner sleeve 15 of the housing which provides an axial bearing passageway adapted to loosely engage the coaxial casing while allowing its free axial movement therein.

The casing 16 is provided with diametrically opposing longitudinal slots 20, which extend through the sidewalls thereof. The slots are preferably enclosed and extend along at least a major portion of the longitudinal extent of the casing.

Figure 4:
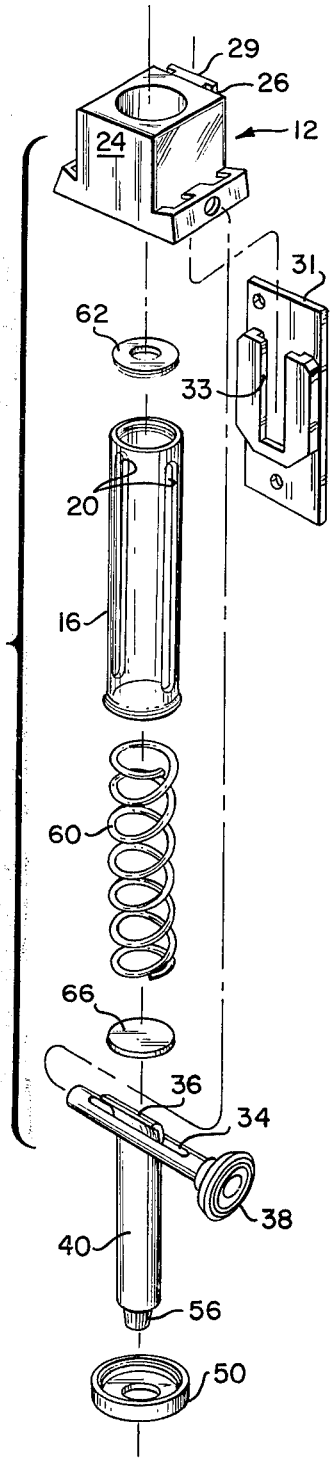
FIG. 4 is an exploded perspective view of the device of FIG. 1.

The dispensing device 10 includes a shaft 30 which is mounted for rotation in opposing sidewalls 22,22 of the housing. The shaft may be journaled in the sidewalls and is preferably removable therefrom for a purpose to be hereinafter described. The shaft includes a collapsible tube end engagement means which preferably takes the form of an enclosed slot 34 extending through the width of the shaft. The slot is sized to allow for the insertion of the end 36 of collapsible tube 40. The shaft 30 further includes a knob means 38 affixed to a terminal end thereof. As best shown in FIG. 4, the knob allows a user to effectively rotate the shaft which will cause the end of the tube to become rolled into an increasing number of convolutions 44.

It will be appreciated that when the dispensing device is assembled, the shaft 30 will extend through each of the slots 20,20 of casing 16 and generally divide the interior of the casing into an upper portion shown by reference numeral 46 and a lower portion shown by reference numeral 48. The lower portion 48 of the casing is adapted to substantially enclose the collapsible tube body 40.

The bottom end of the casing is provided with a detachable tube mounting means which may take the form of a casing bottom cover 50. The cover includes a central orifice 52 which is adapted to allow the dispensing outlet 54 of the collapsible tube to extend therethrough. The orifice is smaller, however, than the diameter of the tube so that tube shoulder 51 will abut against the cover or orifice periphery. The bottom cover 50 may be detachable from the casing by any means well known in the art, such as by the cooperating threads 57 shown in FIGS. 3 and 4 or by a matching snap-fit annular abutment means (not shown) or by simple removable pin means (not shown).

Figure 2:
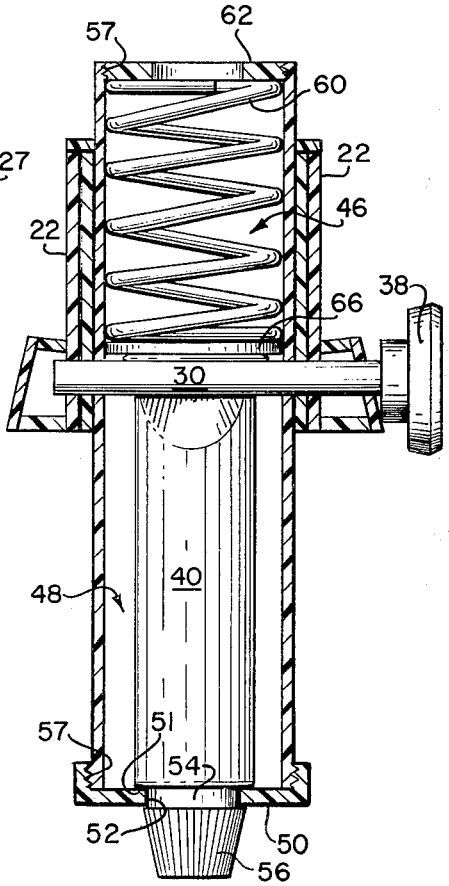
FIG. 2 is a partial sectional front elevation view of the device of FIG. 1 without a toothbrush and wall mounting structure.
Figure 3:
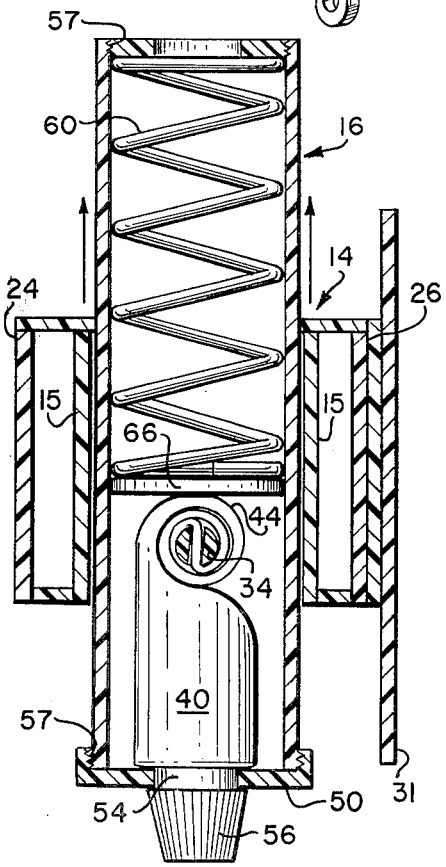
FIG. 3 is a partial sectional side elevation view of the device of FIG. 2 showing the collapsible tube partially rolled upon itself.

As may be seen in FIGS. 2 and 3, the upper portion 46 of the casing contains a spring means shown as compression coil spring 60. The spring means is maintained in axial compression by abutment against the shaft 30 and a spring abutment means located at the top of the casing. The spring abutment means may comprise a threaded top cover 62, as shown in the preferred embodiment or pin means (not shown) or an inner annular ring extending radially inward from the casing sidewalls (not shown).

In the preferred embodiment, the end of spring 60 abuts against a flat disc 66. The disc outline generally conforms to the casing cross-section and rides against the tube 40 as it is rolled about itself in an increasing number of convolutions 44. It will be appreciated that the disc will help prevent the end of spring 60 from interfering with the rolling of the tube 40. An additional advantage of the disc 66 resides in its ability to disperse the axially directed spring force over the flattened diameter of the tube.

It will be understood that for the compression spring 60 to affect an axial force against the end of the tube and across the diameter thereof, the spring will need to have a length at least about equal to or greater than the length of the tube. Specifically it should be longer than the distance from the shoulder area 51 to about the end 36. This is because as the tube becomes rolled upon itself and presents less axial length, the spring will become elongated a corresponding distance. As such, the spring should not be allowed to become fully extended into a relaxed state where it would cease to exert an axial force.

It will also be appreciated that the compression spring 60 cannot exert an outward axial force greater than the longitudinal rigidity of the tube 40. Otherwise, the tube will buckle and/or collapse. This will be understood from observing that the casing is slidable within the support frame 15. As such, the casing is maintained in its position relative to the housing by the spring resilience and the overall length of the collapsible tube. However, as the tube is progressively collapsed by rolling the relatively stiff body of the tube into an increasing number of convolutions, the material contained within the tube will be forced outwardly through the dispensing end 54. Thus, as the amount of material in the tube is gradually diminished, the axial length of the tube body will be reduced. The spring 60 will be continuously pushing against both the casing top cover 62 and the stationary disc 66 or tube body both of which are supported by the shaft 30. Of course, this results in a vertically upward movement of the casing as shown by the arrows in FIG. 3, since the shaft 30 operates as a lower stationary constraint for the axial spring force.

As shown in the drawings, the housing may include auxiliary wall members 25. These wall members may include orifices 27 extending therethrough for the insertion and hanging of a toothbrush therein. Of course, other means such as hooks or the like may be used.

The housing further includes a flanged backwall extension 29. This extension is adapted to cooperate with a wall mount 31 for attachment to a support structure such as a wall, post, cabinet, or the like. The wall mount includes an open-ended offset slot 33 which is sized to slidably engage the backwall extension 29. In this manner, a user may remove the dispensing device from its wall mount to more conveniently exchange an exhausted tube for a new one.

Figure 6:
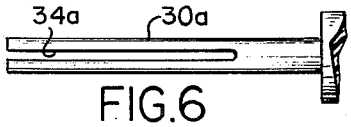
FIG. 6 is a plan view of an alternative shaft member usable with the device of FIG. 1.

Replacement of a dispensing tube may be affected most simply by removing the bottom cover 50 and unwinding the convoluted flattened tube from the tube-end engagement means 34. However, FIG. 6 depicts a modified shaft **30*a* having an open-ended slot 34*a*. In this manner, the shaft 30*a* may simply be pulled axially from the housing sidewalls 22 and become disengaged from the convoluted tube through the slot open end. In this case, the cover 50 will be removed to allow access to the lower casing portion 48** for exchanging tubes.

Figure 5:
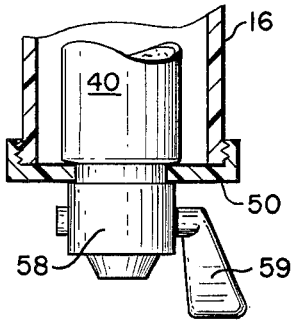
FIG. 5 is a fragmentary front elevation view partly in section of an embodiment of the device of FIG. 1 showing a dispensing valve means.

In another modification of the invention, the dispensing end 54, which includes a closure 56, may be replaced with a valve means. Preferably, the valve means is simply an on-off valve and one which may be screwed upon the dispensing end 54. FIG. 5 shows an exemplary plug valve 58 that operates in a known manner by rotation of handle 59.

It will be appreciated that a significant advantage of the invention resides in the longitudinal adjustment of the casing for different-sized tubular bodies. The spring means provides the casing with a resilient biasing effect thereby allowing it to compensate for different tube lengths.

A further unique feature of the present invention resides in the preferred use of the disc 66 which disperses the axial force from the spring 60 across the bottom of the tube. This insures that the entire contents thereof is being exuded with a progressive rotation of the shaft and subsequent convolution of the tubular container body. Of course, this also facilitates the even exhaustion of the tubular contents and effectively eliminates creases and subsequent ruptures of the thin collapsible tubes.

A still further desirable feature of the present invention resides in the axial movement of the casing relative to the stationary housing. This allows a user to gage whether the tube is near exhaustion or not and provides a novelty interest to the children of a family who may be using such and assists in encouraging dental hygiene. It is within the contemplation of the invention to provide a clear plastic casing, movable figurines or gage markings along the longitudinal extent of the casing indicating the relative amounts of material contained within the tube during use.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

What is claimed is:

1. A device for dispensing the contents of a collapsible tube having a dispensing outlet comprising:

a housing having sidewalls and an integral support frame;

a casing having opposing longitudinal slots extending through the sidewalls thereof and positioned within said support frame and at least partially within said housing, said casing adapted to substantially enclose the collapsible tube and including a spring abutment means at an upper end thereof and a detachable tube mounting means at a lower end thereof;

a shaft extending across the interior of said casing through said casing slots with the opposing end portions thereof mounted for rotation on the housing sidewalls, said shaft including collapsible tube end engagement means; and, a compression spring means positioned within said casing and extending axially between said spring abutment means and said shaft.

2. The device of claim 1 including a disc constructed about coextensive with said casing and located within said casing above said shaft providing an abutment for the end of said spring means against said shaft.

3. The device of claim 1 wherein said detachable tube mounting means comprises a removable bottom end cover for said casing having a central orifice for access to the collapsible tube dispensing outlet.

4. The device of claim 3 wherein said dispensing outlet includes valve means providing on-off communication with the collapsible tube interior.

5. The device of claim 1 wherein said spring abutment means comprises an end cover extending across the top opening of said casing.

6. The device of claim 1 wherein said casing is tubular and said support frame includes a round sleeve mounted in the housing through which the casing slidably extends.

7. The device of claim 6 wherein said opposing longitudinal slots are enclosed and extend along said casing a distance at least about equal to the length of said collapsible tube.

8. The device of claim 6 wherein said housing includes auxiliary wall members having means for storing one or more toothbrushes including means for mounting the device upon a support structure.

* * * * *